US005224650A

United States Patent [19]

Gozikowski

[11] Patent Number: 5,224,650

[45] Date of Patent: Jul. 6, 1993

[54] FIREPLACE FURNACE HEATING SYSTEM

[76] Inventor: David Gozikowski, R.D. #1; Box 279, Falls, Pa. 18615

[21] Appl. No.: 730,999

[22] Filed: Jul. 16, 1991

[51] Int. Cl.[5] ..... F24C 13/00; F24H 3/08

[52] U.S. Cl. ..... 237/55; 126/155; 126/176 R; 126/517; 126/524; 126/528; 126/530

[58] Field of Search ..... 237/55; 126/517, 523, 126/524, 528, 530, 176 R, 155

[56] References Cited

U.S. PATENT DOCUMENTS

| | | | |
|---|---|---|---|
| 1,013,372 | 1/1912 | Brandes . | |
| 1,681,995 | 8/1928 | Miles . | |
| 1,722,560 | 7/1929 | Cornelius . | |
| 2,052,643 | 9/1936 | Modine . | |
| 2,077,599 | 4/1937 | Wales . | |
| 2,151,016 | 3/1939 | Donley . | |
| 2,181,624 | 11/1939 | Maurer . | |
| 2,231,258 | 2/1941 | Elmore . | |
| 2,296,354 | 9/1942 | Kraus . | |
| 2,497,486 | 2/1950 | Barber . | |
| 2,703,568 | 3/1955 | Birch | 126/176 R |
| 3,721,225 | 3/1973 | Tidwell . | |
| 3,773,029 | 11/1973 | Kent . | |
| 3,880,142 | 4/1975 | Fowles . | |
| 4,026,263 | 5/1977 | Boyd . | |
| 4,062,344 | 12/1977 | Mayes . | |
| 4,180,052 | 12/1979 | Henderson . | |
| 4,223,833 | 9/1980 | Ebbers . | |
| 4,270,513 | 6/1981 | Mitchelson | 126/517 X |
| 4,274,393 | 6/1981 | Scaran . | |
| 4,336,790 | 6/1982 | Bartsch . | |
| 4,403,573 | 9/1983 | Cauchy . | |
| 4,426,994 | 1/1984 | Burger et al. . | |
| 4,438,755 | 3/1984 | Moffett . | |
| 4,612,878 | 9/1986 | Schnurer . | |

*Primary Examiner*—Arnold Rosenthal

*Attorney, Agent, or Firm*—Eckert Seamans Cherin & Mellott

[57] ABSTRACT

A fireplace furnace heating system for a structure having a firebox for combustion of fuel, preferably coal. A heating unit is disposed proximately to, and preferably surrounds the firebox. Conduits carry interior air from remote locations to the heating unit. The heating unit is preferably a multi-walled, chambered structure to define numerous air passageways. Air delivered from the conduits to the heating unit must travel through the air passageways. The proximate disposition of the heating unit to the firebox heats the heating unit and the air travelling therethrough. The heating unit has vents for returning the heated air to the interior of the structure. A blower is included for forcible moving the air through the heating unit and back to the interior. Conduits are also provided for supplying fresh air from the exterior to the firebox to fully combust fuel in the firebox. A motorized blower is included to forcibly move the combustion air. Also included is a tempering tank for storing water. The tank has piping for carrying water from the tank to the firebox where it is heated by a fire in the firebox. The heated water is returned to the tempering tank and withdrawn when needed through the structures hot water plumbing system.

27 Claims, 16 Drawing Sheets

FIREPLACE FURNACE HEATING SYSTEM

BACKGROUND OF THE INVENTION

1. Field of the Invention

This invention relates to fireplaces and specifically to coal burning fireplaces functioning as furnaces to completely heat a structure's interior and provide domestic hot water.

2. Prior Art

Fireplaces for providing heat to the interior of living quarters have been around for innumerable years. They have evolved from simple pits in the earth to attractive brick structures which complement the decor of modern homes. Prior art fireplaces generally include a brick hearth for burning wood therein. The burning area is usually closed off from the house interior by a screen or glass doors. Exhaust gasses are vented through the roof of the structure by a chimney. Generally prior art fireplaces are more desirable to the homeowner for their aesthetic value than for heating. Not only does the interior brick work of the hearth add a rustic beauty to the interior but a crackling fire provides the residents with a sense of serenity and security.

Most prior art fireplaces are inefficient heat sources. Modern day homes do not rely exclusively on the heat generated by a fireplace but instead have alternately fueled e.g., gas, electricity or oil systems which meet the heating requirements of the structure. The fire in the fireplace requires oxygen for continued combustion. The combustion supporting oxygen is drawn from the air within the interior's structure. This air is warm relative to the exterior air. The relatively warm air is used in the combustion of, for instance, the logs in the fireplace and vented to the atmosphere through the chimney as exhaust gas. In order to maintain an air pressure equilibrium between the interior air pressure and outside atmospheric pressure, the exhausted interior air must be replaced. Replacement air enters the structure from cracks around, for example, doors and windows, in the foundation, and through exhaust vents, etc. The replacement air entering is relatively cold compared to the interior air, sometimes more than 70° F. colder. The structure's main heating system must work excessively hard to heat the entering cold air. The heat radiated from the fireplace is sufficient to thoroughly heat the room adjacent the fireplace but insufficient to properly heat rooms remote from the fireplace which may be experiencing a great influx of cold air.

Most prior art fireplaces are not designed for use with coal. As compared to wood, coal requires a hotter ignition flame and more oxygen for proper combustion. It would be exceptionally difficult to maintain coal combustion in many prior art fireplaces. Homeowners are restricted to burning wood in their fireplaces. This is unfortunate since coal is a more efficient, cost-effective fuel than wood. Furthermore, anthracite coal, for instance, is plentiful and clean burning.

Prior art fireplaces include, for example, that disclosed in U.S. Pat. No. 1,013,372—Brandes. Brandes discloses a fireplace heater for heating a plurality of rooms.

U.S. Pat. No. 1,681,995—Miles discloses a heater of the fireplace-type which can heat a plurality of rooms. Additional room heating is accomplished by placing return air flues in the rooms to be heated which communicate with the air compartment of the fireplace. Humidity supplying water pans are also disclosed.

U.S. Pat. No. 1,722,560—Cornelius discloses a circulating system for a fireplace for heating rooms remote from the fireplace location. The fireplace draws air from a room adjacent the fireplace and delivers it by ducts to the remote location. An air forcing apparatus such as a fan, is disclosed for delivery of the heated air. Ducts are provided for admitting combustion air beneath the fire.

U.S. Pat. No. 2,052,643—Modine discloses a device for withdrawing air from a room into an adjacent fireplace where it is heated and discharged back into the room under forced draft.

U.S. Pat. No. 2,077,599—Wales discloses a heating system which uses a fireplace as the lone heat source. A blower is used for forced air distribution. The blower is controlled by a thermostat for proper heat regulation.

U.S. Pat. No. 2,151,016—Donley discloses a fireplace with relatively cool air inlets near the foot of the fireplace and heated air outlets at higher points.

U.S. Pat. No. 2,181,624—Maurer shows a forced air fireplace heater generally serviceable from a rear service area. Water-containing plans for supplying humidity to the heated air are included. An ash pit is also disclosed for accumulating the by-products of burning.

U.S. Pat. No. 2,231,258—Elmore discloses a heating system for a conventional fireplace. Forced air return ducts and a blower are disclosed for returning relatively cool air to the fireplace from remote locations for reheating. The reference further discloses ducts for the distribution of heated air to plural, remote rooms.

U.S. Pat. No. 2,296,354—Kraus discloses a forced air fireplace having a thermostatically controlled blower motor. Air is withdrawn from the room adjacent the fireplace, heated and recirculated back to the room. A water pan for providing humidifying water is included.

U.S. Pat. No. 2,497,468—Barber discloses a fireplace having forced draft air conduits communicating with the basement or exterior for providing fresh combustion air to the fire. The reference discloses valves for controlling the amount of draft.

U.S. Pat. No. 3,721,225—Tidwell discloses a pre-fabricated fireplace suited for assembling at the job site.

U.S. Pat. No. 3,773,029—Kent discloses a fireplace damper control operable from the front facing of the fireplace.

U.S. Pat. No. 3,880,142—Fowles discloses a push-pull fireplace damper opening mechanism operable from outside the fireplace.

U.S. Pat. No. 4,026,263—Boyd discloses a fireplace system having a firebox and air supply means for warmed air circulation within the house as well as for providing combustion air to the fire. A thermostat can control the amount of warmed air circulated and/or combustion air supplied.

U.S. Pat. No. 4,062,344—Mayes discloses a fireplace heating system including heating ducts to heat a plurality of rooms and a front mounted damper control.

U.S. Pat. No. 4,180,052—Henderson discloses a fireplace furnace with forced combustion air means, and lower mounted front warm air vents. The system includes a water heater.

U.S. Pat. No. 4,223,833—Ebbers discloses a fireplace unit including a firebox, outside air intake means and forced air heating means.

U.S. Pat. No. 4,274 393—Scaran discloses an insert for an existing fireplace structure having water troughs for supplying humidity to the heated air.

U.S. Pat. No. 4,336,790—Bartsch discloses which can be constructed in place or pre-fabricated which has a blower forcing cool outside air into the firebox where it is heated and emitted into the adjacent room. A pipe delivers water mist to the forced air ducts to maintain sufficient moisture in the heated air. Water circulating and heating apparatus is further shown whereby the fireplace can heat large quantities of water.

U.S. Pat. No. 4,403,573—Cauchy discloses a water heating apparatus attachable to a firebox which stores heated water in a tempering tank.

U.S. Pat. No. 4,426,994—Burger et al. discloses a fireplace having combustion and heating air ducting as well as water heating means.

U.S. Pats. Nos. 4,438,755 and 4,612,878—Moffett and Schnurer each disclose wood burning stoves that heat and circulate water.

Whereas a number of prior art references disclose various means and features to improve the efficiency and usefulness of fireplaces, none disclose a comprehensive, primarily coal burning furnace system which meets all heating needs including heating water for domestic use.

The invention as herein provided goes beyond all prior art fireplaces to disclose a complete home air and water heating system, that may be fueled with coal and that is easily and completely controllable, efficient and maintainable. The invention provides a complete coal burning heating system. No other alternately powered systems are necessary to heat and supply hot water to an average to large sized family home or similarly sized structure. Since coal is readily available domestically, the user of this system can be unconcerned with unstable foreign oil supplies and prices.

SUMMARY OF THE INVENTION

It is a general object of the invention to provide a forced air fireplace furnace.

It is an object of the invention to provide a fireplace furnace which can burn paper, wood or coal.

It is also an object of the invention to provide a fireplace furnace which heats an entire structure interior without requiring a supplementary heating system.

A further object of the invention is to provide a fireplace furnace having easily controllable combustion and heat output.

Another object of the invention is to provide a fireplace furnace which, in addition to heating air, heats domestic hot water.

As means of accomplishing the above-listed objectives, the invention disclosed herein is provided. Fuel to be burned, such as coal, is placed in a specially designed firebox situated in the fireplace hearth. The firebox is connected to a draft assembly which provides outside air for combustion via a closable conduit. It is desirable to include an air blower in the draft assembly for forcefully blowing combustion air into the firebox.

The firebox is surrounded by a heating unit which is heated by the firebox unit. The heating unit contain plural, interconnected chambers and pipes. Interior, return air is drawn from at least one remote register and input to the heating unit through ducts, under the influence of a motorized blower. The purpose of the multiple chambers and pipes of the heating unit is to maximize the distance interior air must flow through the heated heating unit to fully heat the air. According to the design of the invention, return air must flow at least 16 feet over heated metal surfaces of the heating unit before it is exhausted out of the heating unit. Air input to the heating unit from a remote register is preferably first filtered to remove air-borne impurities.

Situated just above the heating unit within the fireplace hearth is a smoke cone. The smoke cone funnels exhaust gasses up to a chimney for exhaustion to the atmosphere. The smoke cone includes an adjustable damper for adjusting the area of the passageway for the exhaust gasses to the atmosphere. The damper control rod juts out through the mantel of the fireplace for easy adjustment of the damper by an occupant of the structure.

The fireplace furnace of the invention also provides domestic hot water. A tempering tank, which may interface with an auxiliary hot water heater, is included to store the hot water. Cold water is input to the tank by the structures plumbing system. The water exits the tempering tank through piping which coils around the firebox. The output from the tempering tank to the coils surrounding the firebox is taken from the bottom of the tempering tank. It is preferable to attach the piping to the outside of the firebox by securing it with approximately 6 inch square pieces of yellow brass. Such a design provides increased heat transfer from the firebox to the water. The water in the piping serves to cool the firebox somewhat and prevent warpage due to an occasional excessively hot fire. The heated water returns through the piping to the top of the tempering tank. Water circulates through the tempering tank and coils under its own pressure and the phenomenon by which cooler water sinks and warmer water rises. Hot water can be drawn from the top of the tempering tank and circulated through the structure's plumbing. Alternatively, the tempering tank can interface with an auxiliary hot water heater. Hot water from the tempering tank is input to the hot water heater before being drawn into the plumbing system. When the heating system is operating at a higher capacity, such as in the fall, winter and early spring months, the water will be sufficiently heated whereby the auxiliary hot water heater functions only as a storage tank. In the spring or summer, when the fireplace is being used in a reduced capacity or not at all, the auxiliary hot water heater will go active to heat the water.

This summary provides a brief overview of the fireplace furnace of this invention. A number of further, preferable embodiments ar possible and will be discussed later. Such embodiments include water pans for humidifying the heated air, timers and speed controls for the air blowers in the draft assembly and the return air blower, pipe cleaners for cleaning creosote from the pipes, and a shakable grate for removing the by-products of combustion.

DESCRIPTION OF THE PREFERRED EMBODIMENTS

The invention is a fireplace furnace heating system which provides heat and hot water to a structure such as a single family home.

Figure 1:
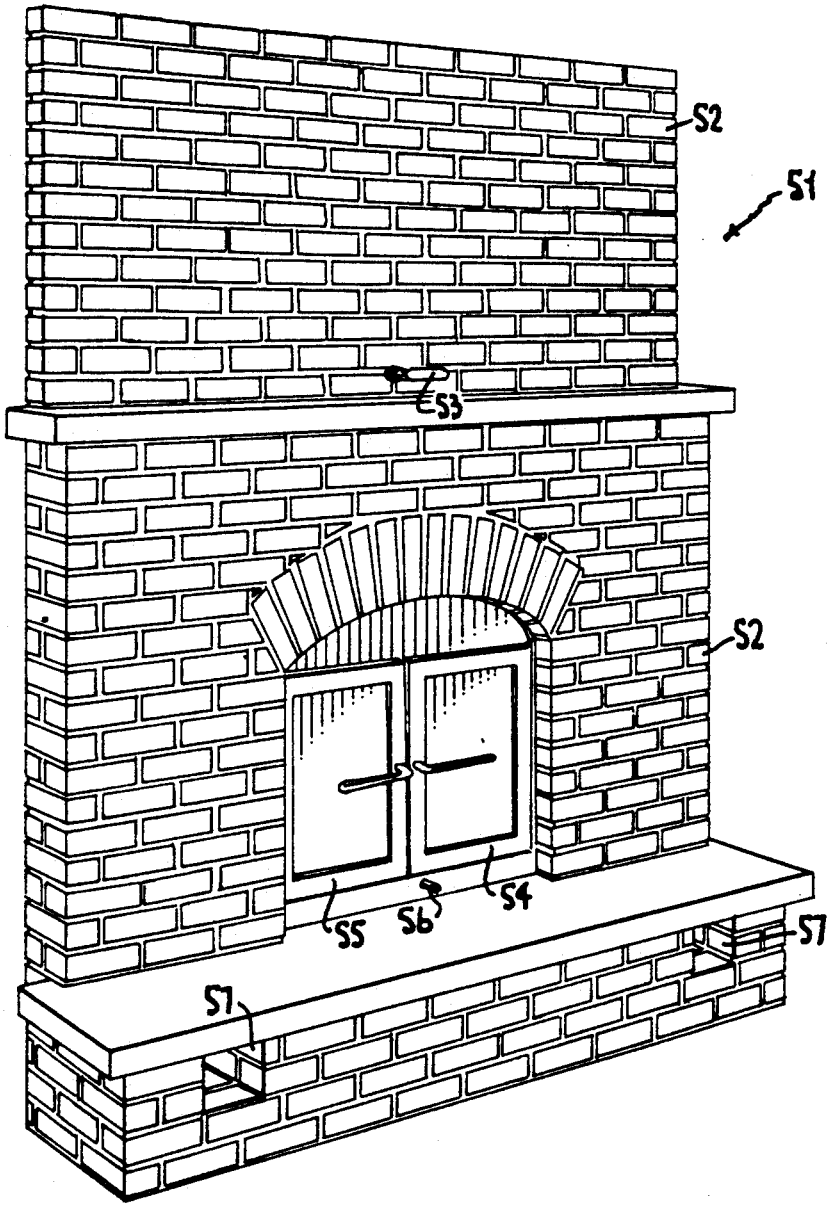
FIG. 1 is a perspective view of the exterior of the front of the fireplace of the invention.

A view of the fireplace from inside the home is shown in FIG. 1. The mantle 52 has damper control rod 53. The damper control rod 53 adjusts the area of an opening permitting exhaust gasses from inside the fireplace hearth to escape to the atmosphere. Right and left side fireplace doors 54 and 55 respectively sealingly enclose the fireplace hearth.

The draft control rod 56 enables an operator to control the amount of combustion air input to the hearth. Warmed air outputs 57 output heated air from the fireplace furnace to, for example, the family home.

Figure 2:
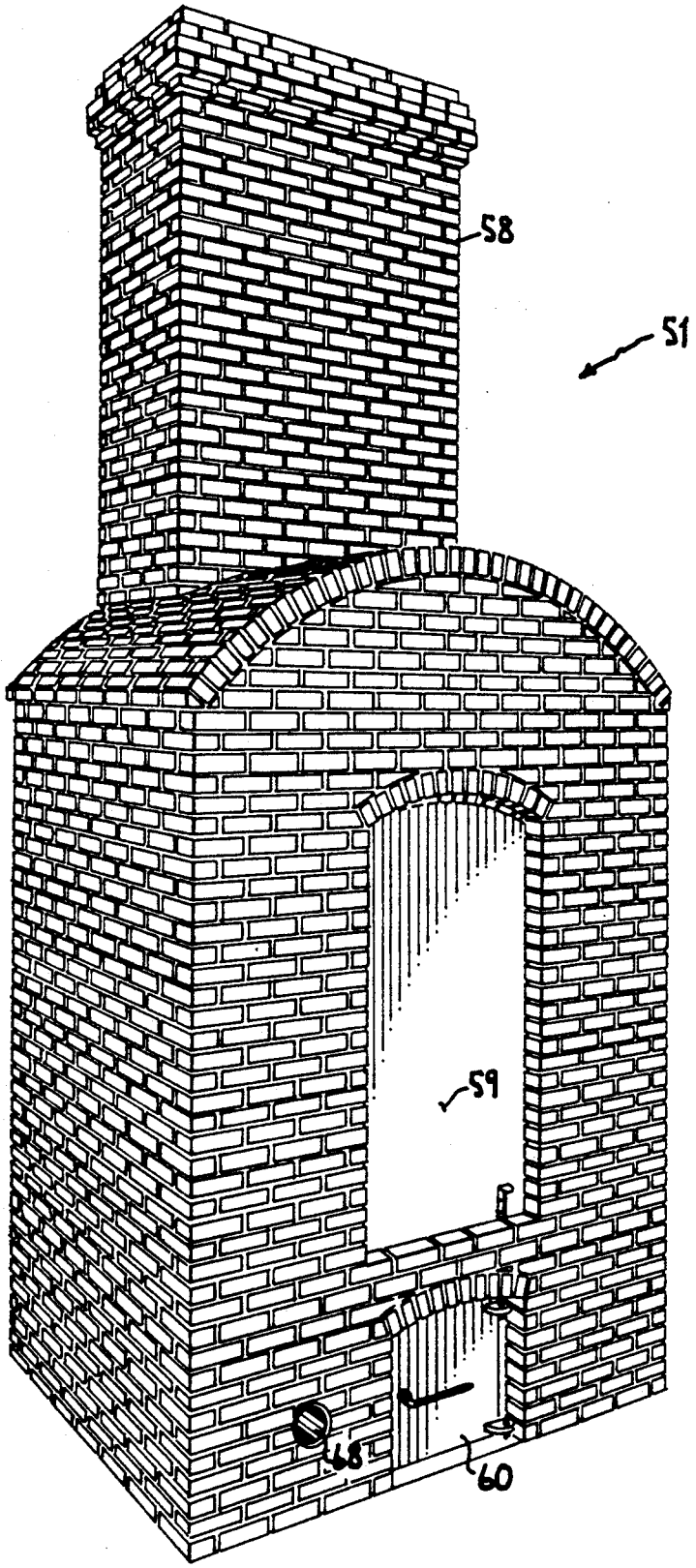
FIG. 2 is a perspective view of the exterior of the back of the fireplace of the invention.

FIG. 2 depicts the view of the fireplace from the house exterior. Chimney 58 serves as a passageway from the fireplace hearth to the atmosphere for venting waste gasses of combustion. Maintenance door 59 allows access to the heating system 51. Within maintenance door 59 preferably reside for example, a tempering tank an auxiliary water heater, various electrical controls and conduits for water and electricity. Just beneath maintenance door 59 is ash pit door 60. Ash pit door 60, when opened, allows a user to access an ash pit beneath grate 61 (not shown in FIG. 2) to clean out the ashes which accumulate during use. Ash pit door 60 should provide an air tight fit when closed to prevent excessive air from entering the hearth and causing an undesirably large, hot fire.

An end of combustion air conduit 68 is mounted on the rear of fireplace system 51. The conduit provides a passageway for exterior air to the firebox. Air from the exterior is used to combust the fuel. No air from the interior of the structure is required for combustion. In fact, right and left fireplace doors, 54 and 55 respectively, provide an air tight fit to prevent warp interior air from being used in combustion and exhausted up chimney 58. This design provides a high degree of heating efficiency since warm house air is not used for combustion as in prior art fireplaces.

Figure 3:
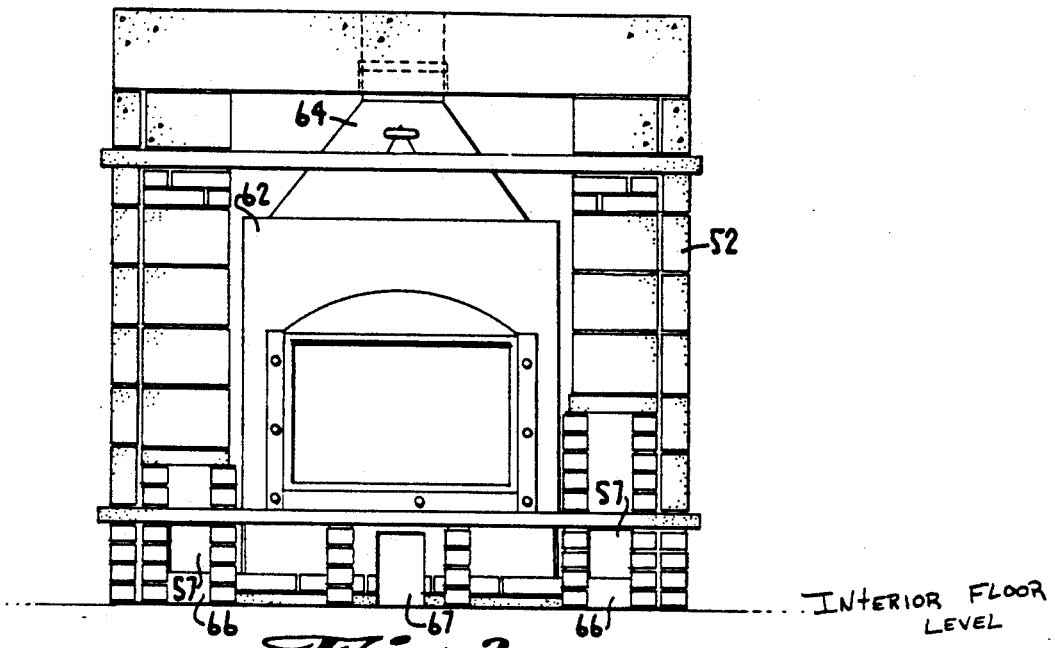
FIG. 3 is a front cut-away view of the heating unit situated within the mantle.

In FIG. 3, heating unit 62 is situated within mantle 52. Heating unit 62 is of primary importance. Heating unit 62 is comprised of many interconnected passageways for channeling air through the heating unit. Firebox 63 (not shown in FIG. 3) is essentially surrounded by heating unit 62. In this manner, air in heating unit 62 is exposed to the heat emanating from firebox 63 thereby being warmed and recirculated back into the structure. A more thorough description of heating unit 62 will occur below. Smoke cone 64 sits atop heating unit pipes 65 (not shown in FIG. 3), which connect heating unit left side piece 102 with right side piece 103 (not shown in FIG. 3). Combustion gasses from, for instance, burning coal are gathered by smoke cone 64. Smoke cone 64 communicates with chimney 58 so that combustion gasses in smoke cone 64 are exhausted to the outside through chimney 58.

Also shown in FIG. 3 are water trays 66. Water trays 66 are preferably filled with water. Water trays 66 preferably have four sides and a bottom but no top so that the water is not separated from warmed air output 57. In this manner, the warmed air can be humidified by water evaporating from water trays 66. Outside air elbow 67 directs air from conduit 68 up towards the bottom of firebox 63.

Figure 4:
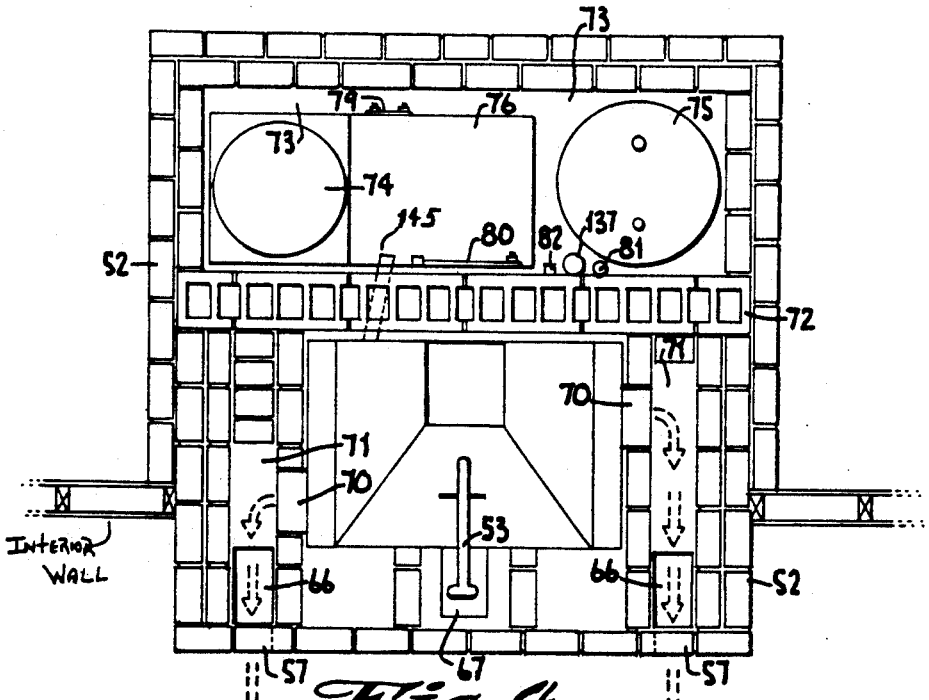
FIG. 4 is a top, partial plan view of the invention.

FIG. 4 is a top partial view of system 51. Heating unit 62 is positioned beneath smoke cone 64 and resides centrally within mantle structure 52. Heated air departs heating unit 62 at air openings 70. Air openings 70 lead the heated air through warmed air conduits 71 to warmed air outputs 57. Warmed air conduits 7 can be tubes constructed of, for instance, sheet metal, however they are preferably formed by the brickwork of mantle 52. The warmed air in warm air conduits 71 passes over water in water trays 66 before exiting through warmed air outputs 57. Damper control rod 53, adjusts the size of an opening in smoke cone 64 to control the amount of exhaust vented through chimney 58 (not shown in FIG. 4).

Concrete blocks 72 define maintenance area 73. Maintenance area 73 includes, for example, auxiliary hot water heater 74, return air blower housing 76, and tempering tank 75. Tempering tank 75 is used for hot water storage and will be discussed further below. Tempering tank 75 should be constructed from, for instance, stainless steel, glass lined steel, copper or galvanized, dipped steel to maintain water purity. The tank 75 should have a pressure rating above that of the home plumbing system. The larger the tempering tank 75 used, the more hot water can be stored.

An auxiliary hot water heater 74 is also placed in maintenance area 73. Auxiliary hot water heater 74 is a gas or electric powered water heater of the conventional design. It is not necessary to use an excessively large auxiliary water heater 74 since during early spring, winter and fall system 51 will provide hot water which is stored in tempering tank 75. Only when system 51 is or dormant, or when there is a large demand for hot water, will auxiliary water heater 74 be needed to heat water for the occupants of the residence.

Return air blower housing 76 houses return air blower 77 (not shown in FIG. 4). Return air blower 77 blows air which has been drawn into return air conduit 84 (not shown in FIG. 4) from a remote location in the structure into the heating unit. Housing 76 contains an air filter. The air filter removes air borne dust and dirt particles so that only clean, particulate free air is heated and vented to the structure. Housing 76 includes air filter cover plate 79. Removal of cover plate 79 allows an occupant to access the air filter for removal and replacement when clogged or dirty.

Clean-out door 80 allows access to the interior of smoke cone 64 and the interior of chimney 58. In this manner, a chimney sweep or other person can clean out smoke cone 64 and chimney 58 using appropriate tools. It is important to maintain cleanliness of these components especially if wood or other fuel is burned in place of, or in addition to, anthracite coal.

Electrical conduit pipe 81 is shown along concrete blocks 72 and houses the electric wires necessary for energizing the various electrical components of system 51. Firebox water pipe 82 circulates water to firebox 63. Piping conduit 137 circulates hot and cold domestic water to and from system 51, in particular tempering tank 75. The plumbing system will be discussed with more particularly hereinafter.

Figure 5:
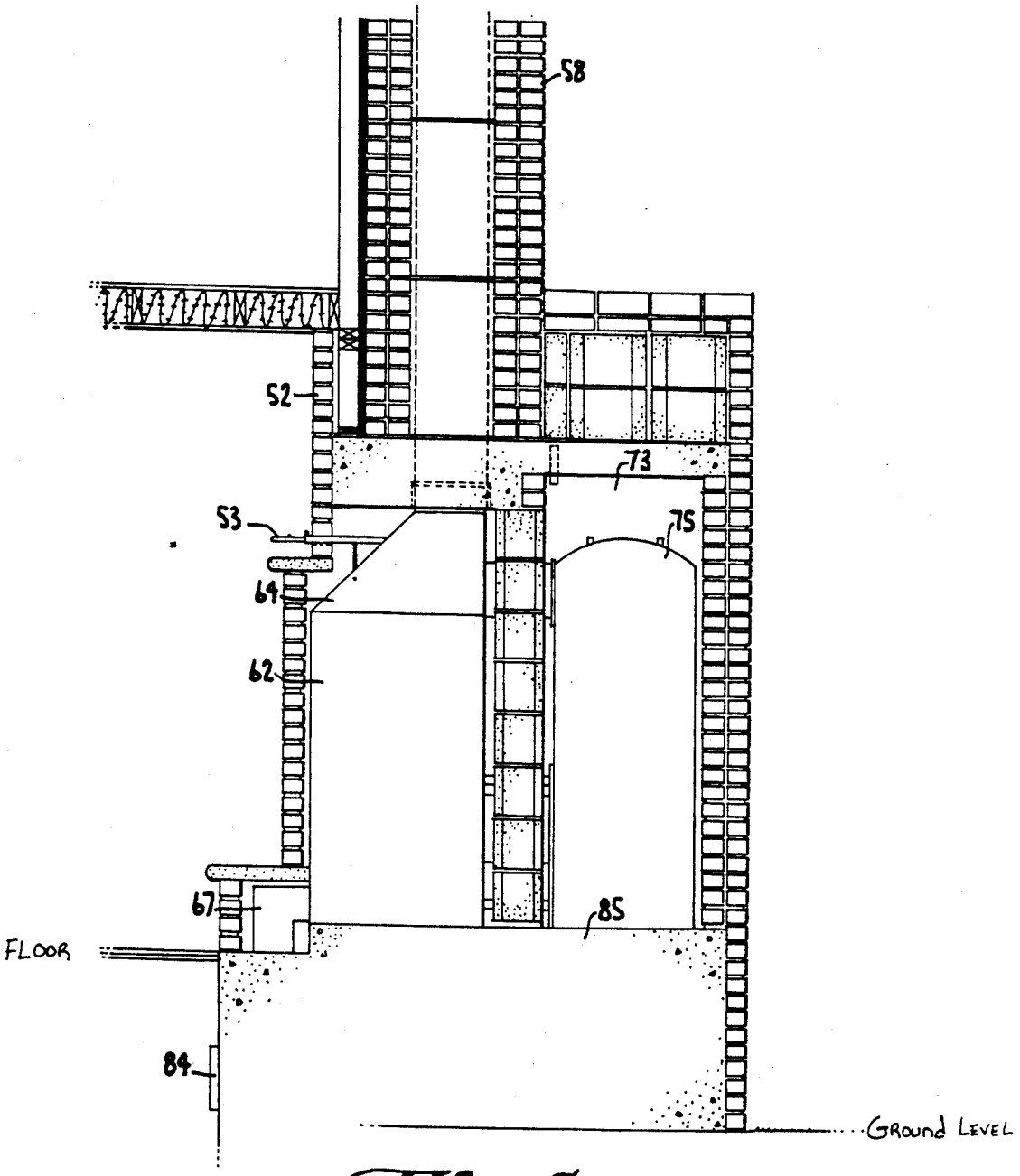
FIG. 5 is a right-side cut-away view showing the heating unit and tempering tank.

FIG. 5 shows heating unit 62 and tempering tank 75 positioned within mantle 52 and maintenance area 73. Also shown in FIG. 5 is return air conduit 84. Return air conduit 84 brings return interior air from a remote register into heating unit 62 or preferably, return air blower 77 (not shown in FIG. 5). As discussed below, return air conduit 84 travels below the floor to a remote register to provide a passageway from a remote area of the structure to heating unit 62 or return air blower 77. Once the air enters heating unit 62, of course, it is heated and returned to the structure interior under the force of return air blower 77. Outside air elbow 67 directs exterior air into draft control assembly 91 (not shown in FIG. 5).

Figure 6:
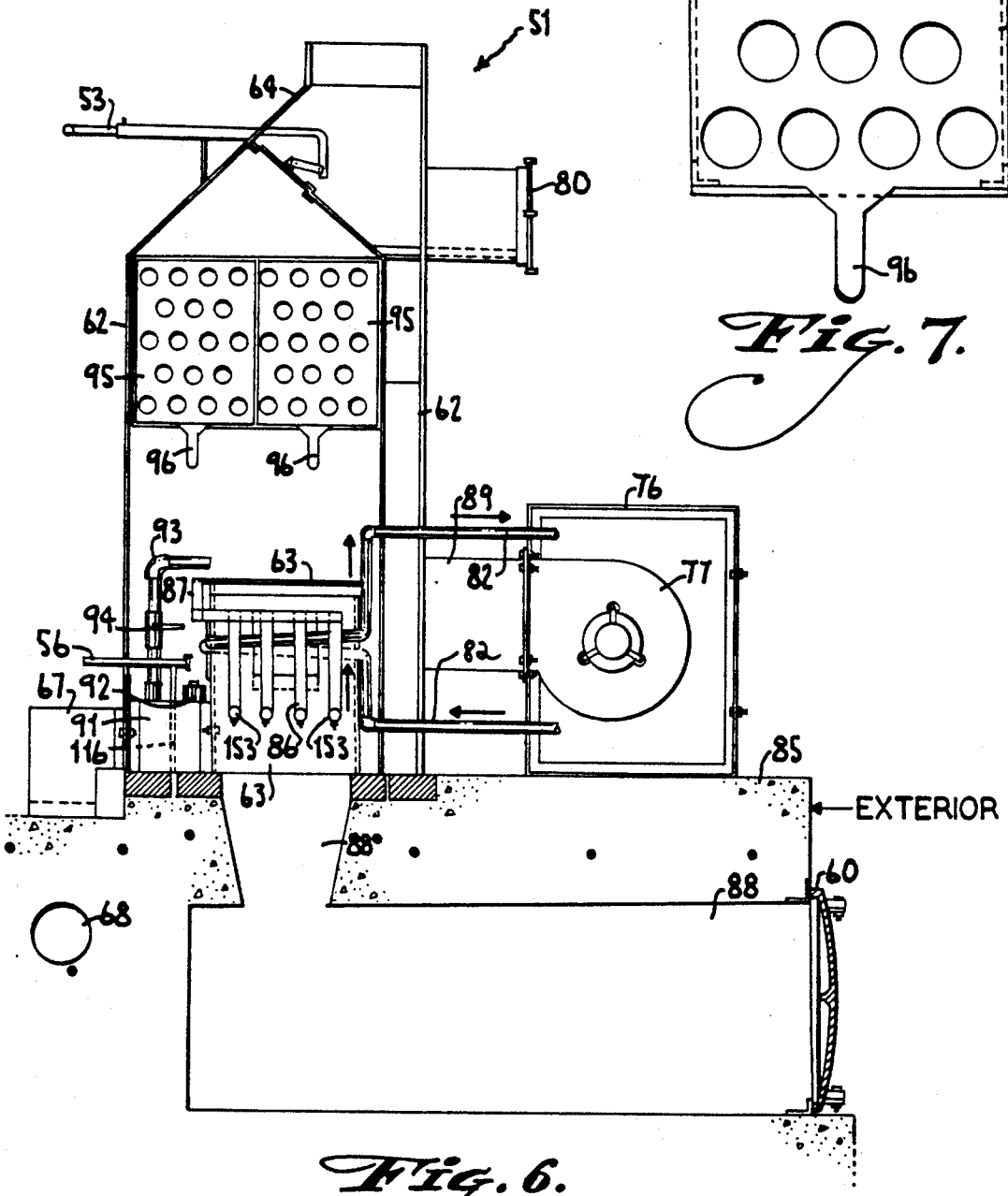
FIG. 6 is a right-side cut-away view showing the interior of the heating unit and the return air blower housing.

As shown in FIG. 6, firebox 63 has four-shaker arms 86 and shaker handle 87 which can be operated to pivot grate 61 (not shown in FIG. 6) to force accumulated ashes into ash pit 88. Grate 61 is attached to firebox 65 at pivot points 153. Accumulation of too much ash on grate 61 could interfere with fuel combustion, however it is beneficial to have some ash bed to prevent small embers from dropping into ash pit 88 whereby their radiated heat would be wasted.

Return air blower housing 76 houses return air blower 77. Return air blower 77 can be of any known type but is preferably of the type having a separate motor and wheel. A motor with approximately 1050 R.P.M. and a 4 to 5 amp rating is preferred. The motor should preferably operate on house current i.e., 115 volts at 60 Hz. The motor should be mounted using a torsion type mounting bracket to eliminate vibrations. Blower 77, of course, forces return air through heating unit 62. System 51 thus functions as a forced air heating system. Air travels between blower 77 and heating unit 62 through blower tunnel 89. Blower 77 is preferably speed adjustable to control the volume of heated air input to the structure.

Also shown in FIG. 6 is firebox water piping 82. The firebox water pipe 82 pipes water from tempering tank 75 (not shown in FIG. 6) around firebox 63. The water is heated in its path around firebox 63. Firebox water piping 82 connects to tempering tank 75 at its top and near its bottom. Cooler water will accumulate at the bottom of tempering tank 75 and will enter the firebox water piping 82 attached near the bottom of tempering tank 75. The water will travel around firebox 6 where it will be heated and emptied back into the top of tempering tank 75. In this manner water will continuously circulate through the hot water heating section of system 51.

Outside air elbow 67 leads combustion air from combustion air conduit 68 into draft control assembly 91. Draft control assembly 91 has draft control rod 56 to control the amount of combustion air input to firebox 63. Draft control assembly 91 also has draft relief plate 92. Draft relief plate 92 primarily functions as a emergency device to provide an air escape from firebox 63 in case, for instance, ash pit 88 develops an air leak which would provide excess combustion air to firebox 63 causing any fire to burn too hot. Draft control assembly 91 also has draft by-pass 93 and draft by-pass valve 94. Opening draft by-pass valve 94 directs combustion air directly to the top of firebox 63. Draft by-pass 93 is useful to direct combustion air into a fire when grate 61 (not shown in FIG. 6) and firebox 63 become clogged with ashes. This most commonly occurs when system 51 is burning wood. Draft control assembly 91 and its related components will be discussed in more detail below.

Figure 7:
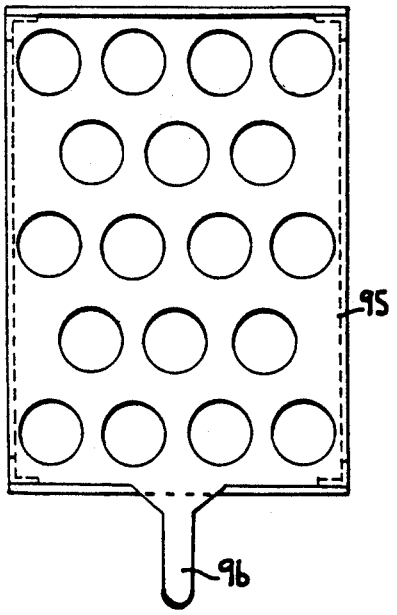
FIG. 7 is a side view of a pipe cleaner.

Also shown in FIG. 6, and in FIG. 7 are pipe cleaners 95 having pipe cleaner handles 96. Each of the individual heating unit pipe sets 105 and 110 (DTG), (not shown in FIGS. 6 and 7) passes through one of the apertures shown in pipe cleaner 95. Pipe cleaners 95 are slid from side to side over heating unit pipes 65 by grasping handles 96. The side to side motion of pipe cleaners 95 over the heating unit pipes scrapes the pipes clean of contaminants Which build up as a by-product of combustion. Particularly troublesome is creosote, which will build up if system 51 is used to burn wet or green wood.

Figure 8:
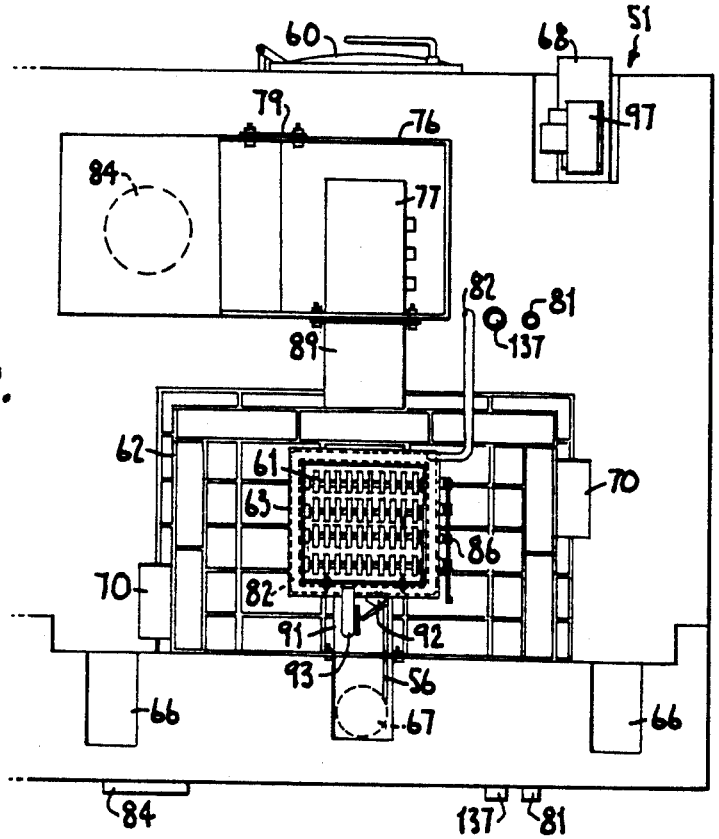
FIG. 8 is a cut-away partial top view of the invention.

FIG. 8 is a partial cross section top view. Combustion air blower 97 is mounted in the path of combustion air conduit 68. Combustion air blower 97 draws fresh air from the outside and forces it into combustion air conduit 68. Combustion air conduit 68 leads to outside air elbow 67 which channels the fresh air upward into draft control assembly 91. Draft control assembly 91 directs air into firebox 63 beneath grate 61 or through draft bypass 93. Combustion air blower 97 is used when starting or pushing a fire and is controlled by an on-off switch. Return air blower 77 can be operable by a timer for timed increments of operation along with an optional full on-off switch. Return air conduit 84 leads return air from a remote vent into return air blower housing 76 which houses return air blower 77.

Figure 9:
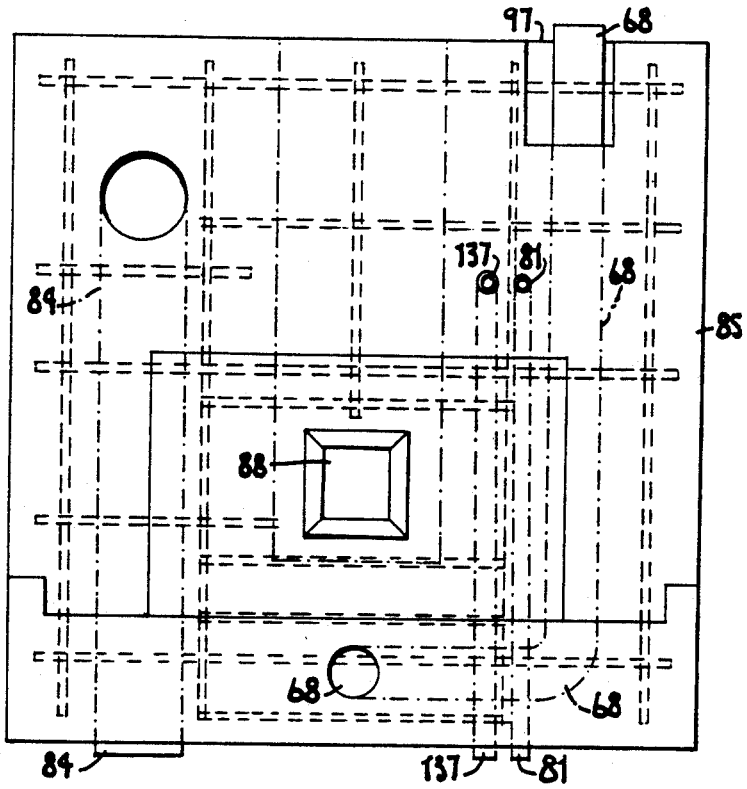
FIG. 9 is a top cut-away view of the foundation.

The foundation section 85 is shown in FIG. 9. Return air conduit 84 leads return air from a remote register back to the system. Ash pit 88 is formed in the center of the foundation beneath the heating unit for the collection of the by-products of combustion, namely ashes. Combustion air conduit 68 leads fresh air from outside of the structure to outside air elbow 67 (not shown in FIG. 9). Outside air elbow 67 brings air up to draft control assembly 91 (not shown in FIG. 9). As noted, combustion air blower 97 forcefully inputs combustion air to the system. Combustion air blower 97 is controllable to regulate the volume of combustion air supplied.

Electrical conduit pipe 81 and piping conduit 137 are also located in foundation 85.

Figure 10:
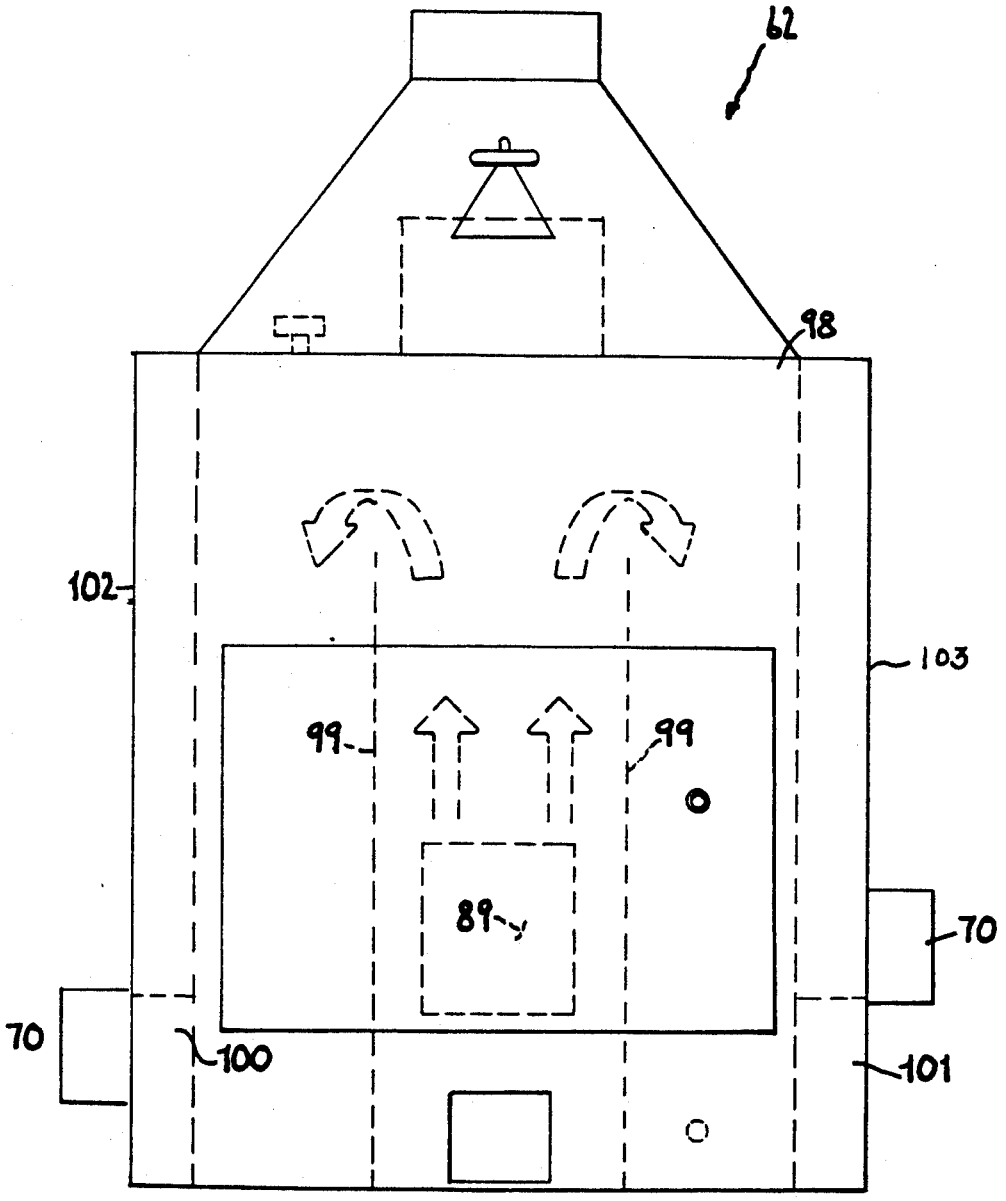
FIG. 10 is front view of the back of the heating unit diagrammed for showing air flow within.
Figure 13:
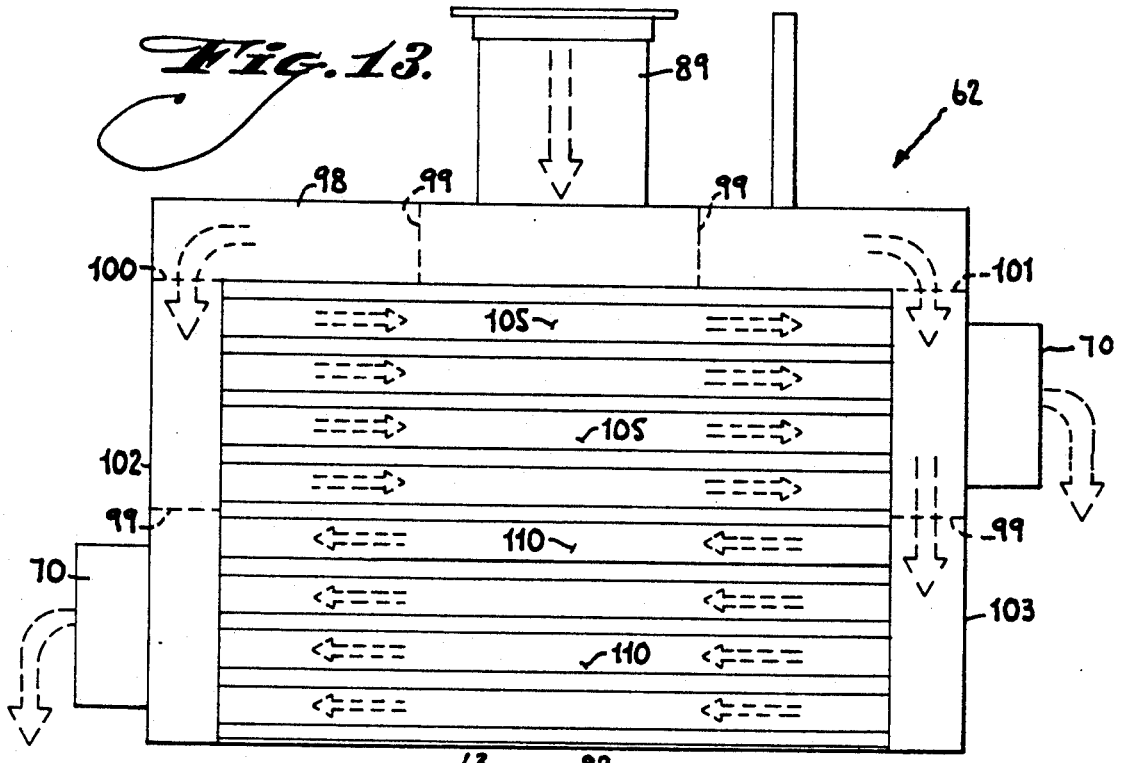
FIG. 13 is a top view of the heating unit diagrammed for slowing air flow within.

FIGS. 10–13 depict the flow of air through heating unit 62. The view in these drawings (FIGS. 10–13) is a front view showing the back of the unit 98 (FIG. 10), a view showing the top of the unit (FIG. 13) and the left and right side views (FIGS. 11 and 12) showing left side of unit 102 and right side 103. In FIG. 10, return air from a remote register is drawn into return air conduit 84 by return air blower 77 (not shown in FIGS. 10–13). Return air blower 77 blows air into heating unit 62 through blower tunnel 89. Blower tunnel 89 is fixedly attached to the center of heating unit backpiece 98. Heating unit backpiece 98 is a double walled piece to define chambers for the flow of air. The walls are preferably spaced 4 inches apart. Air which enters heating unit backpiece 98 at blower tunnel 89 flows upward as shown by the arrows in FIG. 10. The air is channeled between double walled backpiece 98 by barriers 99. Barriers 99 are metal sections which reside between the walls of back piece 98 at right angles to each of the walls of backpiece 98 as shown in FIG. 13. At the top of heating unit backpiece 98, the air splits into two directions and is channeled back down backpiece 98 as shown by the arrows of FIG. 10. Left side backpiece opening 100 directs air into heating unit left side piece 102 and right side backpiece opening 101 directs air into right side piece 103. Left side piece 102 right side backpiece opening 101 directs air into and right side piece 103 are also of double walled design with barriers 99 affixed therebetween to define air channels In FIG. 11, air from left side back piece opening 100 enters left side section piece 102. Air is channeled up left side piece 102 in the channel formed in left side piece 102 by barrier 99. At the top of left side piece 102 the air enters 18 steel pipes 105, preferably 1½ inches in diameter and is carried above firebox 63 (not shown in FIGS. 10–13) into heating unit right side piece (See FIGS. 12 and 13). Air enters right side piece 103 from pipes 105 and is channeled down to a warmed air Opening 70, through warmed air conduit 71 (not shown in FIGS. 10–13) and exhausted into the structure through warmed air output 57.

Figures 11, 12:
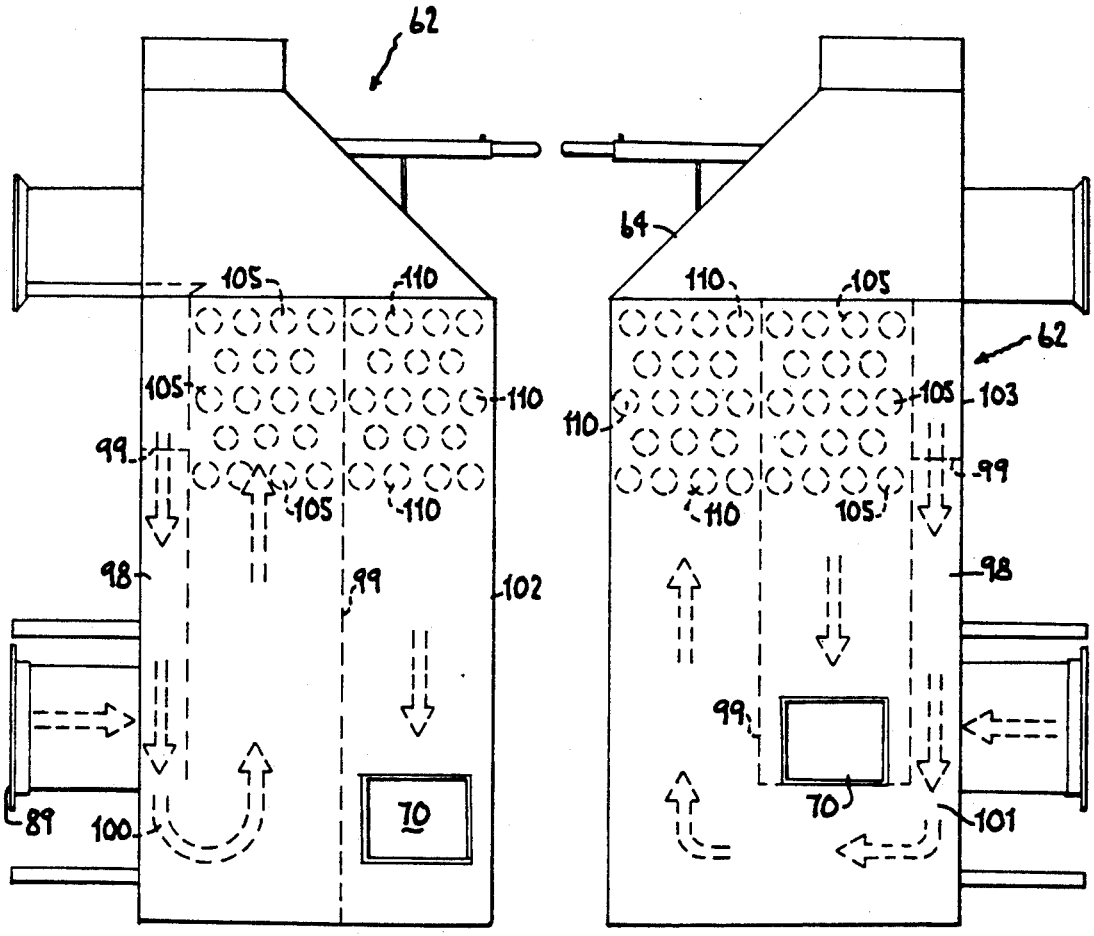
FIG. 11 is a left side view of the heating unit diagrammed for showing air flow within.
FIG. 12 is a right side view of the heating unit diagrammed for showing air flow within.

The air from right side back piece opening 101 enters heating unit right side section piece 103 (see FIG. 12). Air is channeled to the left of right side piece 103 (see arrows) and up to and through 18 steel 1½ pipes 110 by barrier 99. Air travels to left side piece 102 through pipes 110 and down to warmed air opening 70. Air from warmed air opening 70 is vented to the structure interior via warmed air conduit 71 and warmed air output 57.

Heating unit 62 surrounds firebox 63 on-three sides. Heat from firebox 63 heats all pieces 98, 102 and 103 of heating unit 62. Pipes 105 and 110 reside above firebox 63 and are also heated by firebox 63. A top view of heating unit 62 showing pipes 105 and 110 is shown in FIG. 13. Heat is transferred from firebox 63 to the air travelling through pieces 98, 102, 103 and 105 and 110. The relatively great distance the air travels in its paths through heating unit 62 insures that it is thoroughly heated before being returned to the structure interior. This long distance allows a slow burning fire to efficiently heat the moving air.

Figure 14:
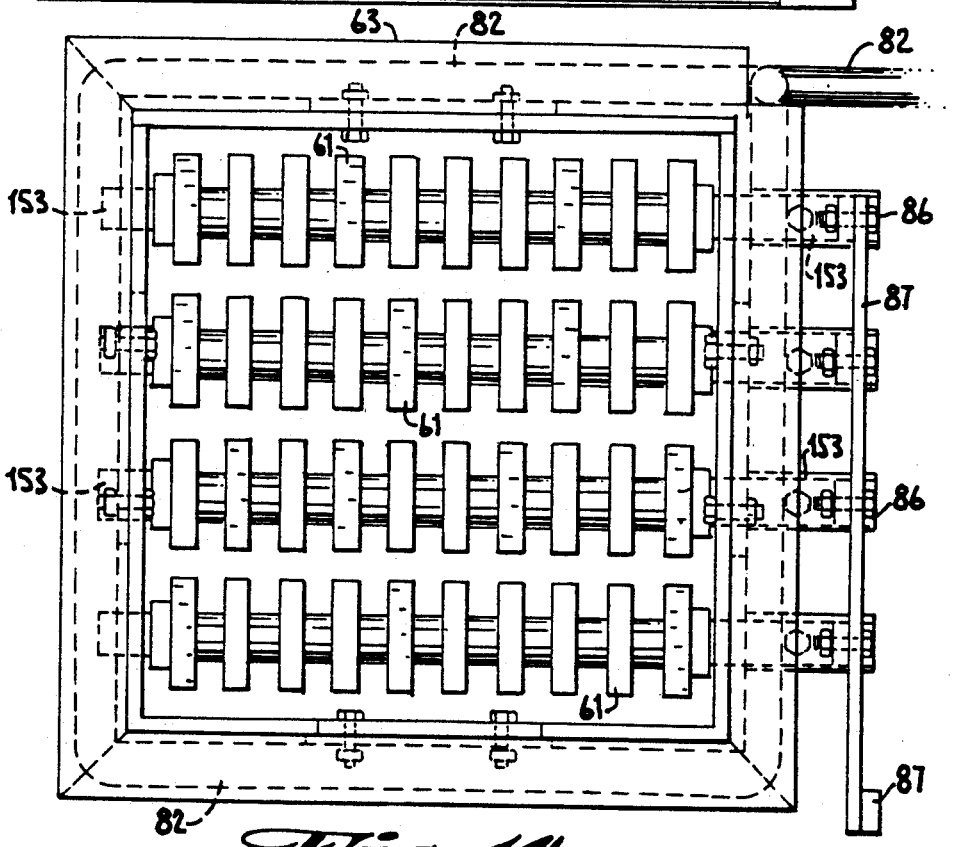
FIG. 14 is a top view of the grate and firebox.
Figure 15:
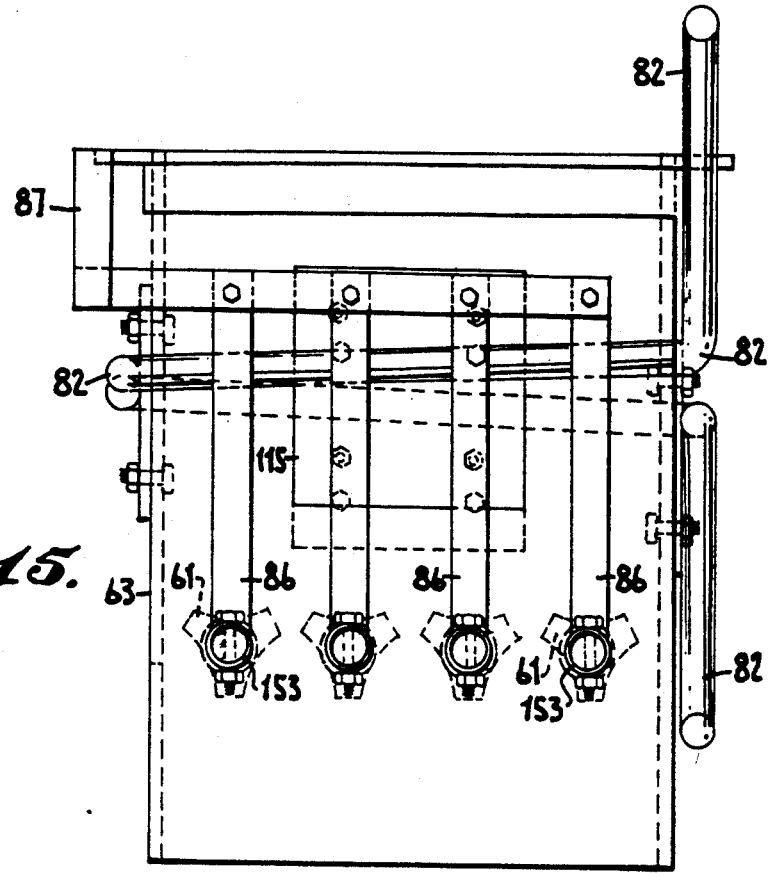
FIG. 15 is a right side view of the firebox.
Figure 16:
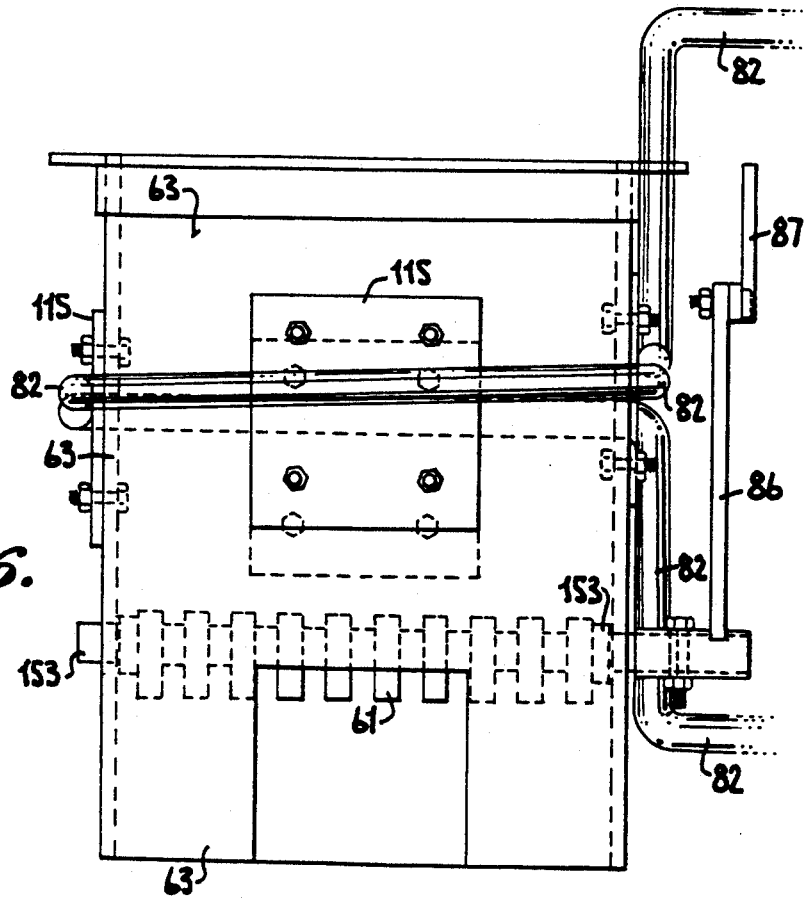
FIG. 16 is another right side view of the firebox showing the disposition of the grate within.

It should be recognized that a particular channel configuration for pieces 98, 102 and 103 have been shown and described. A number of other channels configurations could be used in the scope of this disclosure. The particular configurations shown are not limiting. Furthermore, 36 pipes are shown in FIGS. 10–13. This is not a requirement. More or fewer pipes can be used and their diameter modified in accordance with the intention of the invention. The channel design and pipe quantity and diameter chosen should provide good air flow and maximum heat transfer. Referring to FIGS. 14–16, a detail of firebox 63 and grates 61 is shown. Grates 61 rest in the frame of firebox 63. Grates 61 are pivotably attached to firebox 63 at pivot points 153 allowing rocking of grates 61 about their longitudinal axes, by movement of shaker handle 87. Shaker arms 86 depend from an end of grates 61 and shaker handle 87 to effect the movement of grates 61.

The attachment of firebox water piping 82 to firebox 63 is also shown in FIGS. 14–16. Firebox water piping, as noted above, carries water to and from tempering tank 75 (not shown in FIGS. 14–16). Firebox water piping 82 encircles firebox 63 so that heat from a fire in firebox 63 will heat the water in firebox water piping 82. To increase the efficiency of the heat transfer, firebox water piping 82 is attached to firebox 63 by securing it with heat exchange plates 115. These heat exchange plates 115 are preferably constructed of yellow brass and are fitted over firebox water piping 82, thereby essentially increasing the surface contact area of the firebox water piping 82 with firebox 63.

Figure 17:
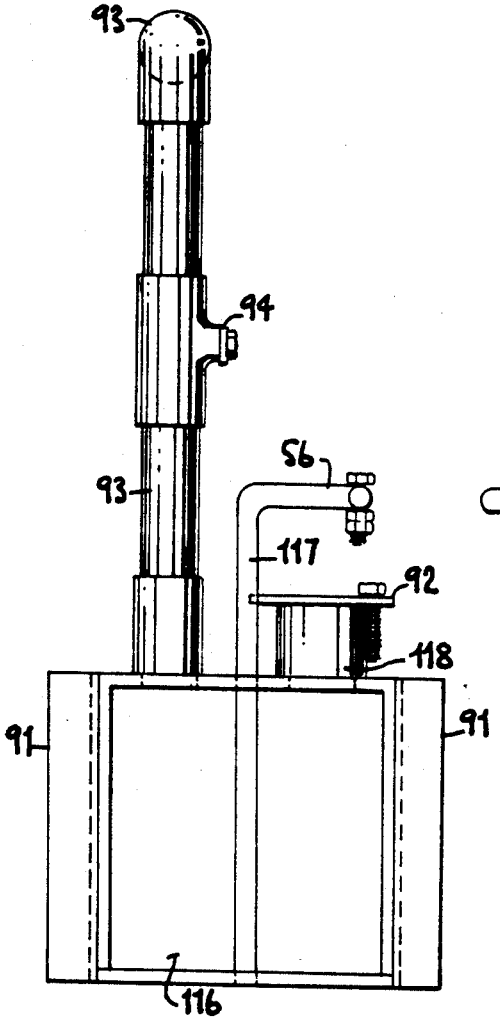
FIG. 17 is a front view of the draft control assembly.
Figure 18:
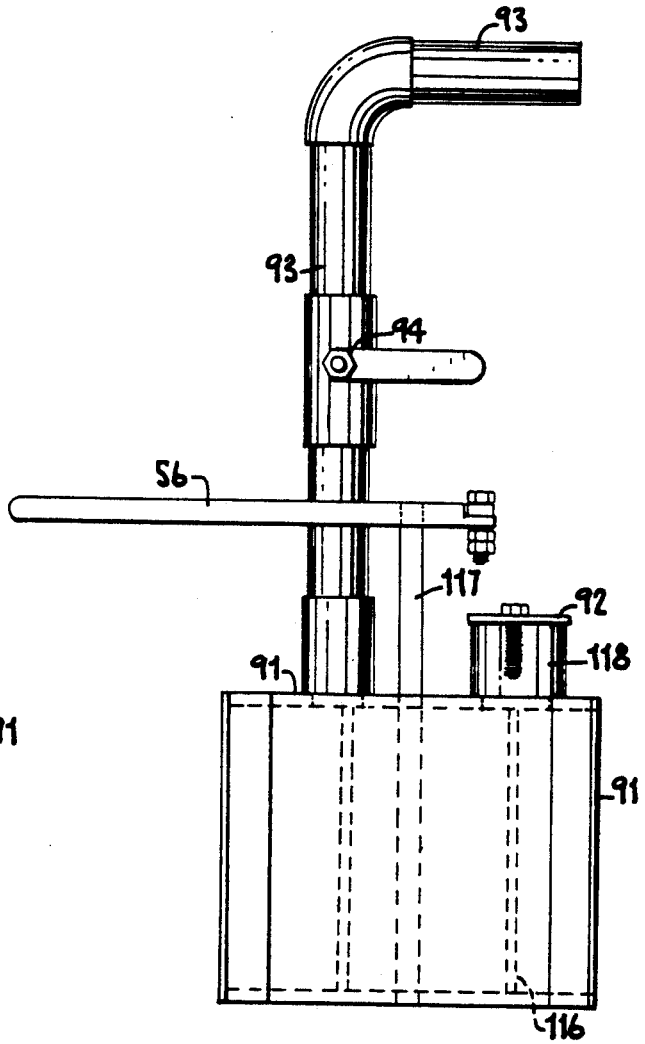
FIG. 18 is aright side view of the draft control assembly.
Figure 19:
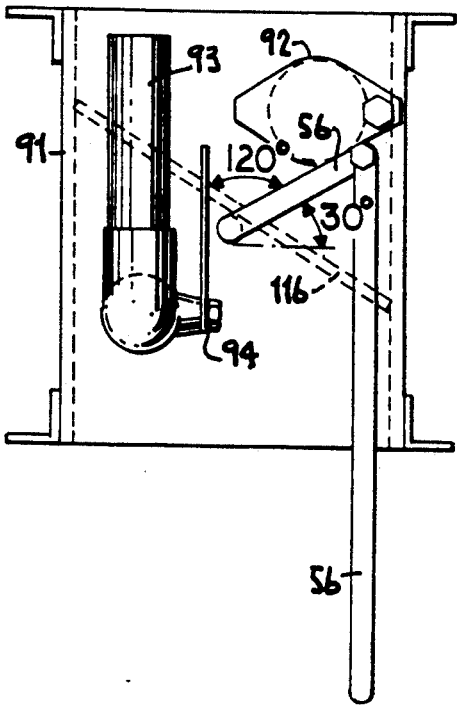
FIG. 19 is a top view of the draft control assembly.

FIGS. 17–19 depict the draft control assembly and its related components. Combustion air is input to a firebox from outside air elbow 67 (not shown in FIGS. 17–19) through draft control assembly 91. The size of the air passageway through draft control assembly 91 can be controlled by swiveling draft control plate 116 about a center axis. Draft control plate 116 can be swiveled by movement of draft control rod 56 in or out which rotates draft control rod extension 117 and draft control plate 116. When draft control rod 56 is pushed completely in, draft control plate 116 will completely shut the air passageway through draft control assembly 91 to severely inhibit the intensity of a fire in firebox 63. When the rod is pulled out to its limit, control plate 116 pivots whereby the air passageway is essentially completely open. A large volume of combustion air will be supplied when control rod 56 is out thereby providing an intense, hot fire.

As shown in FIG. 6, air through draft control assembly 91, enters at the bottom of firebox 63. Air will rise through firebox 63 to help burn combustible matter placed on grates 61 located inside firebox 63. Of course, if grates 61 are severely clogged with ash, or if a more direct flow of combustion air is required, draft by-pass valve 94 can be opened. Draft by-pass valve 94 opens a passageway for air from draft control assembly 91 through draft by-pass 93. Draft by-pass 93 is piping which, as shown in FIG. 6, directs air from draft control assembly 91 to the top of firebox 63, thereby bypassing the normal path of air into the bottom of the firebox. In normal operation, draft by-pass valve 94 is left in the closed position.

A further feature of draft control assembly 91 is draft relief plate 92. Draft relief plate 92 normally covers draft relief nozzle 118. If an air leak develops, for instance in ash pit 88, virtually uncontrollable amounts of air could feed a fire in firebox 63. This could result in a dangerously large, hot fire. By sliding draft relief plate 92 from draft relief nozzle 118, an air escape path is created from draft control assembly 91 to divert air from firebox 63. Draft relief nozzle 118 is located between firebox 63 and draft control plate 116 whereby draft control plate 116 can seal off draft control assembly 91 without closing the air escape path through draft control nozzle 118.

Figure 20:
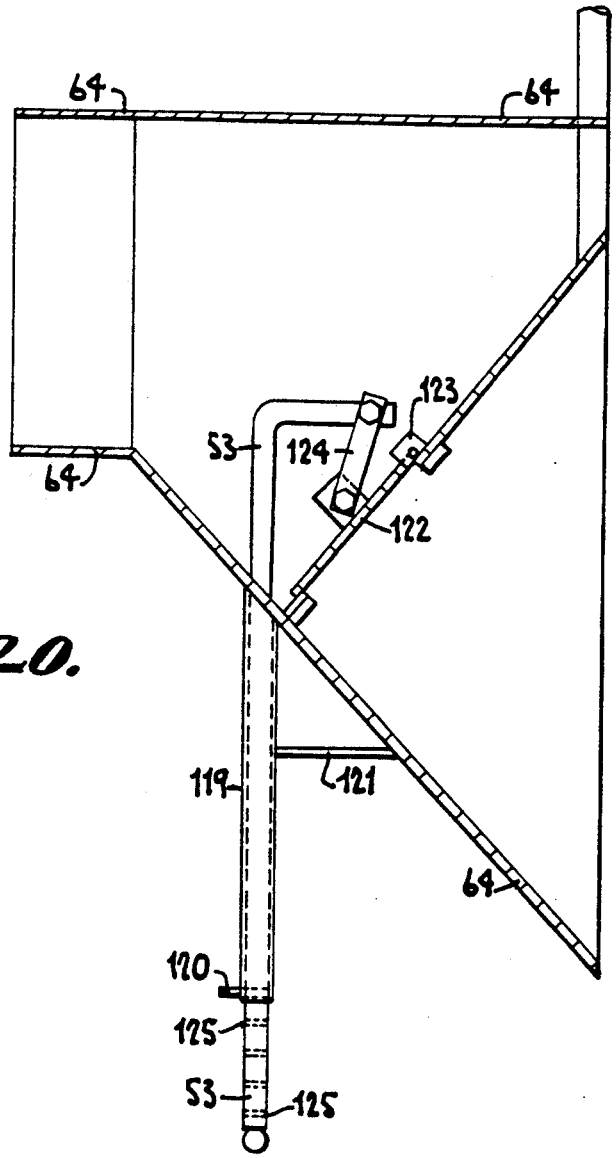
FIG. 20 is a right side cut-away view of the smoke cone.

A cross section view of smoke cone 64 is shown in FIG. 20. Smoke cone 64 provides a passageway for exhaust gasses from firebox 63 to chimney 58. The size of the passageway opening is selectable by lateral movement of damper control rod 53. When pulled out to its most outward stop point, damper plate 122 is in the position shown in FIG. 20 thereby substantially closing off smoke cone 64. The position shown in FIG. 20 will most likely be used, for example, in the summer when system 51 is inactive. When a fire burns in firebox 63, gasses must be exhausted. Damper control rod 53 can be pushed in and held in a chosen position by inserting damper rod pin 120 in one of a number of damper control rod holes 125. When pushed in, damper control rod 53 slides within damper rod guide 119. Damper rod guide 119 is supported by damper rod support 121. Damper control rod extension 124 is rotatably attached to damper control rod 53 and damper plate 122 at its opposing ends. When damper control rod 53 is pushed in, damper control rod extension 124 pulls back on damper plate 122. Damper plate 122 pivots back about damper plate hinge 123 thereby opening a path through smoke cone 64. A notch is preferably cut out of the top center of damper plate 122 so that it does not strike control rod 53 when it pivots back about damper plate hinge 123. The notich is also a safety feature by allowing same escape of exhaust gasses even when the damper plate is in a fully closed position.

Figure 21:
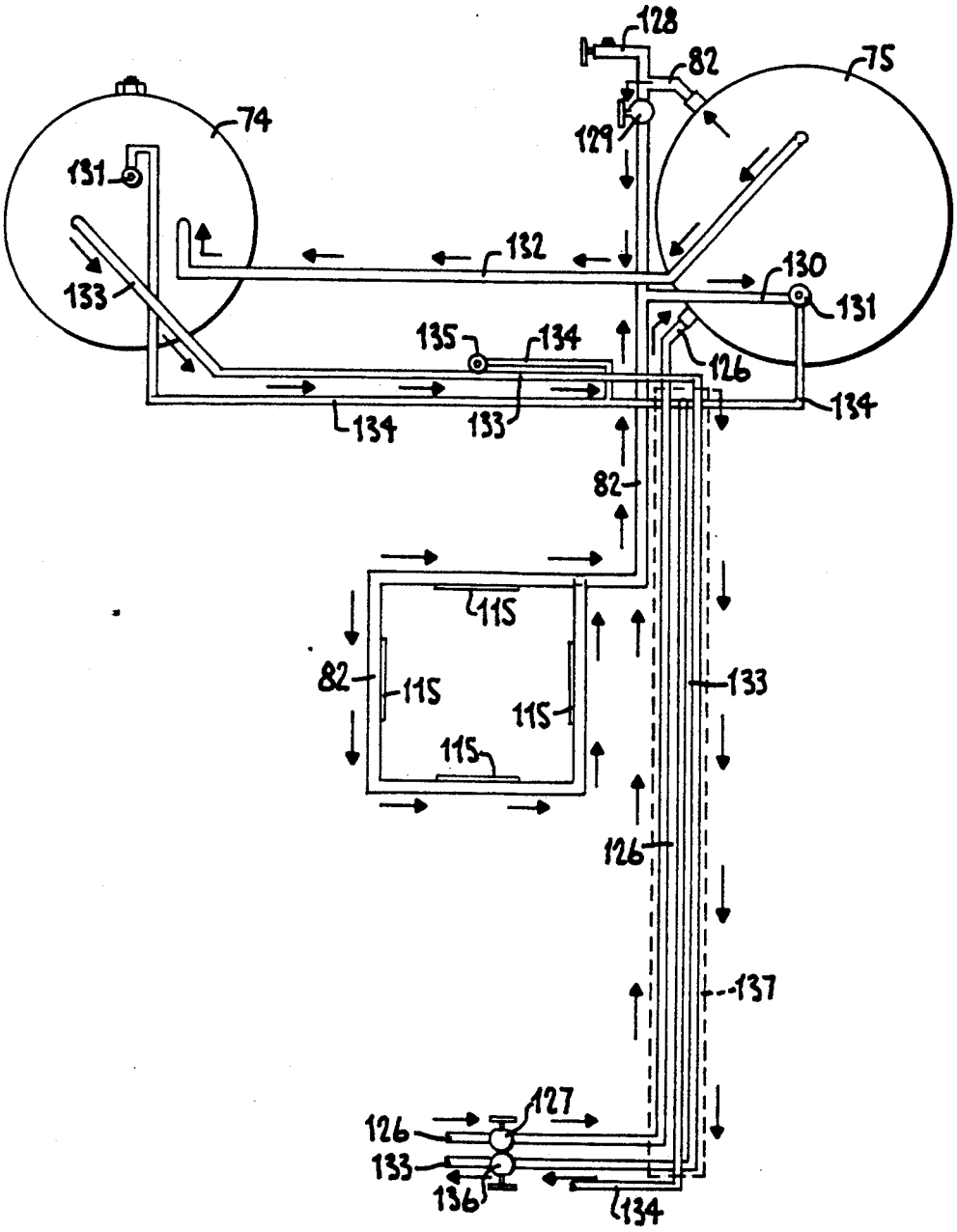
FIG. 21 is a schematic plumbing diagram.

FIG. 21 is the plumbing diagram. Cold domestic water is input to domestic cold water input pipe 126. It is preferable to include cold water shut off valve 127 to provide means for shutting off fresh, cold water to the system. Cold water-shut-off valve 127 should include a drain for draining water trapped in domestic cold water input pipe 126 between cold water shut-off valve 127 and tempering tank 75. Cold water input pipe 126 connects near the bottom of tempering tank 75 as shown. Cold water is drawn from tempering tank 75 by firebox water piping 82. Firebox water piping 82 has drain spigot 128 for draining the water system including tempering tank 75. Tempering ball valve 129 is included for helping to regulate the temperature of the hot water in the tempering tank. Tempering ball valve 129 regulates the water flow around firebox 63. It is extremely important that tempering ball valve 63 never be completely closed. If tempering ball valve 129 is completely closed, firebox water piping 82 could be irreparably damaged. When first operating system 51, ball valve 129 should be opened completely to evaluate its effect on water temperature. If the water is not heating properly, valve 129 can be closed somewhat to slow the recirculation of water thereby allowing it to get hotter. Hotter fires require ball valve 129 to be more fully open than moderate fires. Family size, water usage, weather and location will dictate the operational position of tempering ball valve 129. It is preferable to keep the water in tempering tank 75 heated to 140° F. to keep auxiliary water heater 74 from turning on.

Water flows through firebox water piping 82 and around firebox 63 (not shown in FIG. 2;). Firebox water piping 82 is affixed to the sides of firebox 63 with heat exchange plates 115 to improve heat transfer to the water. Warmed water returns to tempering tank 75 at warmed water return pipe 130. Pressure relief valve 131 is an adjustable or pre-set pressure relief valve positioned atop the tank where water return pipe 130 inlets warmed water to tempering tank 75. The actual pressure setting of pressure relief valve 131 will depend on the pressure of the home water system. A setting of 150 psi is normally acceptable. Pressure relief valve 131 should also have a 210° F. setting. When the plumbing system is being filled, it may be necessary to open relief valve 131 to allow air in firebox water piping 82 to escape.

When hot water is required in the home warmed water at the top of tempering tank 75 is drawn off by connecting piping 132. Water from connecting piping 132 empties into auxiliary hot water heater 74. Water is drawn from auxiliary hot water heater 74 through domestic hot water pipe 133. As discussed above, in cold weather when system 51 is operating at full capacity, auxiliary water heater 74 will remain off thereby simply storing hot water from tempering tank 75 just prior to use. In the summer for instance, when system 51 is off or operating at a diminished capacity, auxiliary hot water heater 74 will operate to provide heat or additional heat to the water. Auxiliary hot water heater 74 also has pressure relief valve 131. Pressure relief valves 131 are connected by pressure relief drain pipe 134. Pressure relief drain pipe 134 leads to pressure relief drain 135 for draining any water released by the pressure release valves 131. Hot water from auxiliary hot water heater 74 is introduced to the remainder of the home plumbing system through domestic hot water pipe 133. For whatever reason, hot water may be shut-off by hot water shut-off valve 136. Normally, hot water shut-off valve 136 should be left in the fully open position to ensure an adequate hot water supply to the home. It is further desirable to place domestic cold and hot water pipes, 126 and 133 respectively, and pressure relief drain pipe 134 in piping conduit 137, for convenience.

Figure 22:
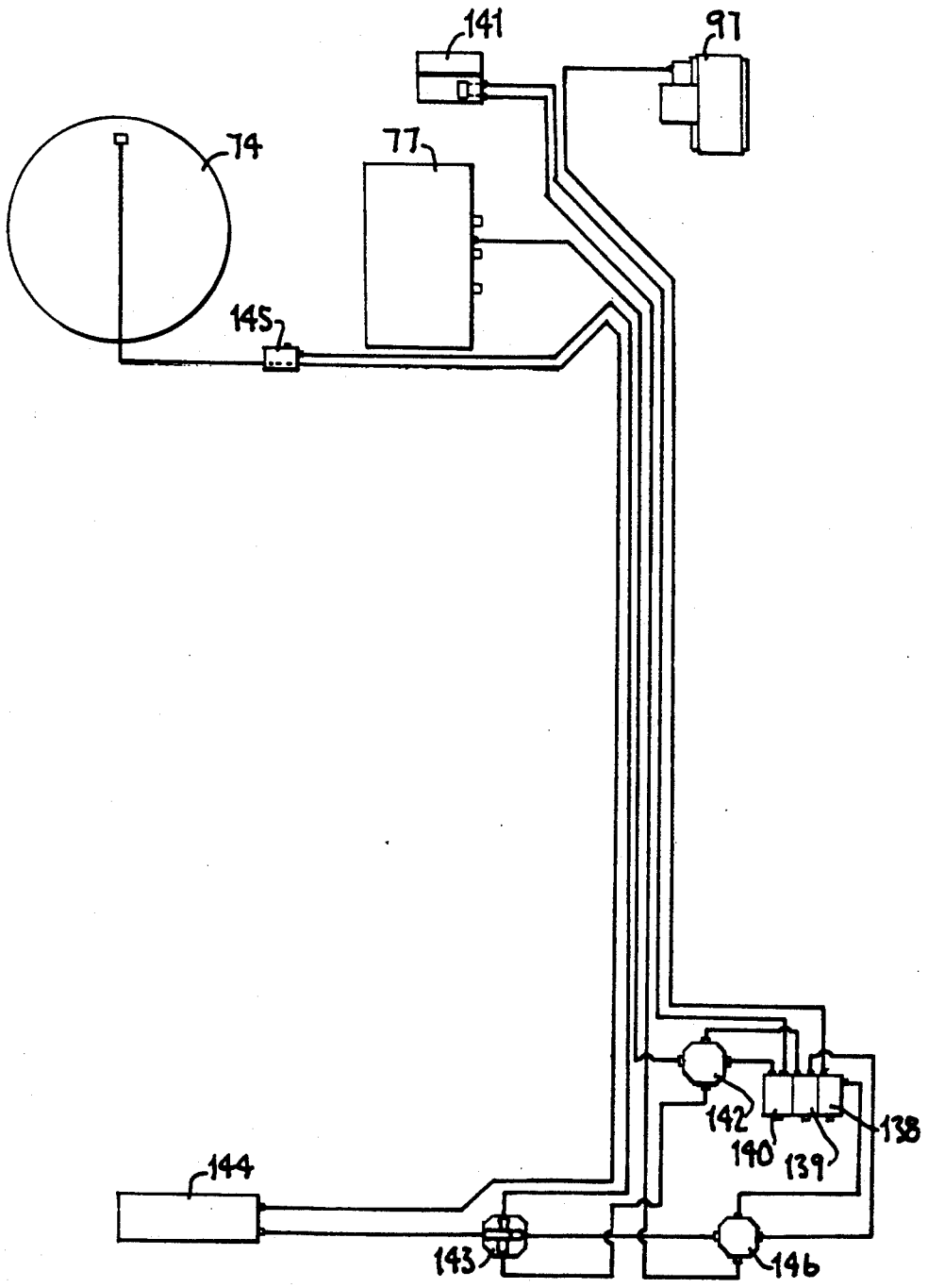
FIG. 22 is a schematic electrical diagram.

FIG. 22 shows the electrical system necessary to make system 51 operational. Combustion air blower switch 138 is a motor grade wall switch. It must exceed the amperage drawn by combustion air blower 97. Combustion air blower switch 138 is typically mounted on an interior wall of the structure. Combustion air blower switch 138 turns combustion air blower 97 on or off. The main purpose of the blower is to permit fast starting of a fire.

Speed control switch 139 controls the speed of return air blower 77. Return air blower 77, of course, blows recirculated air through system 51 and into the structure interior. Adjustable speed switch 139 provides an occupant with proper control of the amount of warmed air to be introduced to the interior.

Timer control switch 140 activates return air blower timer 141. Timer control switch 140 is an on-off switch. Return air blower timer 141 cycles return air blower 77 on and off. Return air blower timer 141 preferably consists of 96 permanently fixed trippers. This allows a setting of fifteen minutes off and fifteen minutes on for a 24 hour day, everyday. Return air blower timer 141 can also be set for specific on and off times.

Return air blower junction box 142 connects adjustable speed switch 139 and timer control switch 140 to return air blower 77. Return air blower switch 142 is also tied to power supply junction box 141. Power is supplied to power supply junction box 143 from main supply box 144.

Main supply box 144 is typically the main power supply in most structures. It should be modified for use with system 51 by installing two additional circuit breakers. Fifteen amp, ground fault trip breakers should be used. Power supply junction box 143 distributes power to heat limit switch 145, return air blower junction box 142 and secondary power supply junction box 146. Secondary power supply junction box 146 supplies combustion air blower switch 138, adjustable speed switch 139 and return air blower timer 141 with power.

Heat limit switch 145 is placed in a pipe extending from heating unit 62 (see FIG. 4). The heat limit switch protects heating unit 62 from becoming too hot, due to, for example, human error. Heat limit switch 145 is activated when surrounding temperature exceeds a preselected threshold limit. Once the limit is exceeded, switch 145 will turn return air blower 77 to a full on setting, thereby providing rapid circulation of air through heating unit 62.

Auxiliary water heater 74 is depicted connected directly to main supply box 144.

Figure 23:
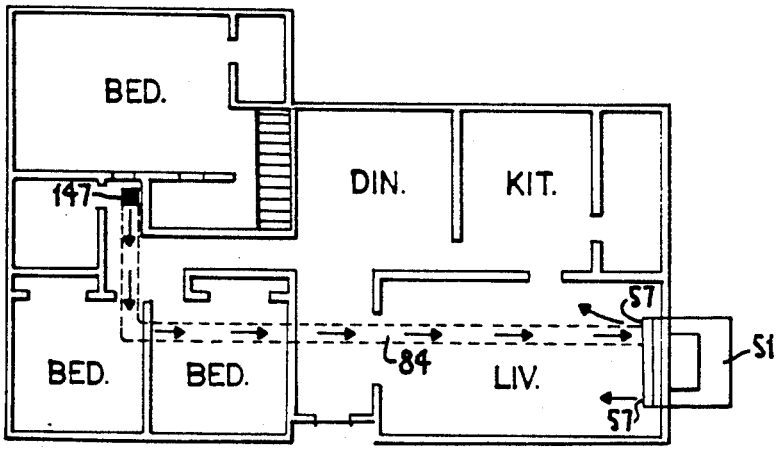
FIG. 23 is an air flow diagram of the invention disposed in a single level home.
Figure 24:
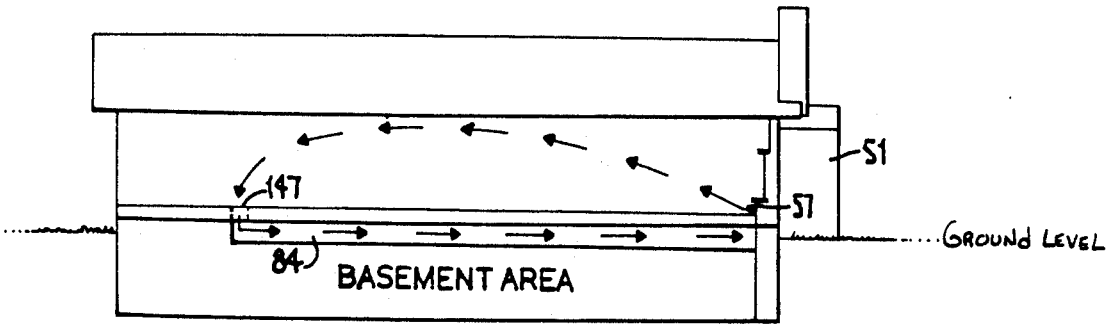
FIG. 24 is another air flow diagram of the invention disposed in a single level home.

FIGS. 23 and 24 are air flow diagrams of system 51 disposed in a single level structure, such as, a rancher. System 51 outputs warm air from warmed air outputs 57. Warmed air spreads throughout the house but eventually is drawn into register 147 under the influence of return air blower 77 (not shown in FIGS. 23 and 24). Air is returned to system 51 for reheating through return air conduit 84.

Figure 25:
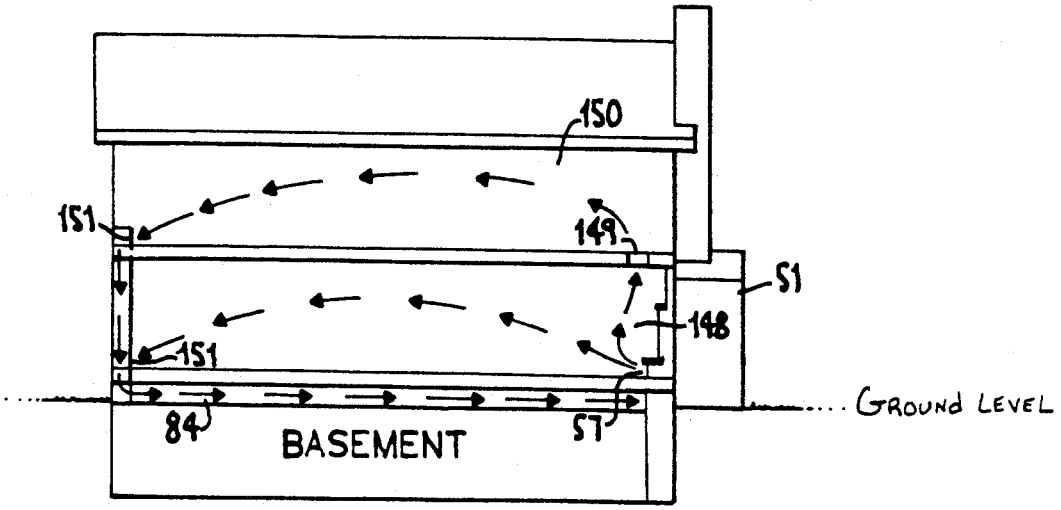
FIG. 25 is an air flow diagram of the invention disposed in a two story dwelling.
Figure 26:
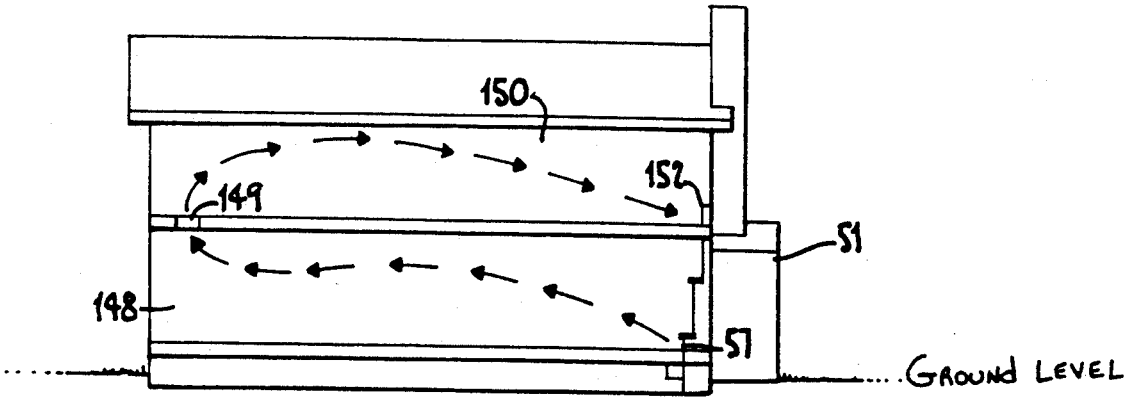
FIG. 26 is an alternate air flow diagram of the invention disposed in a two story dwelling.

FIGS. 25 and 26 depict possible air flow diagrams of a two story dwelling. In FIG. 25, system 51 outputs warm air through warmed air outputs 57. Air enters first story 148 from outputs 57 and rises through heat register 149 to second story 150. After heating both stories, the air is drawn into register conduit 151 by return air blower 77 and returned to system 51 through return air conduit 84.

In FIG. 26, warmed air output from warmed air outputs 57 is output into first story 148. Air travels throughout first story 148 and up into second story 150 through heat register 149. Heated air travels back through second story 150 to return air conduit 152 now disposed in a wall above system 51. Return air conduit 152, as with return air conduit 84, leads return air to return air blower 77 (not shown).

It can be appreciated from the above that the invention provides excellent, efficient heating and hot water production for a moderately sized structure such as a single family home. The invention is designed to burn coal, an efficient and plentiful fuel. Its novel design improves over prior art fireplaces in terms of heat production and efficiency.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What I claim is:

1. A fireplace furnace heating system for a structure having an interior and an exterior and a plumbing system, comprising a firebox having plural sides, and a grate for placement and burning of combustible materials therein;

a draft control assembly having a closable conduit from under said firebox to the exterior of the structure for supplying said firebox with fresh air for combustion;

a chambered heating unit having at least one air input and at least one air output, plural walled sides and a plural walled back, said plural walling defining a cavity for the movement of air therein, said top of said heating unit comprising plural hollow pipes for connecting said plural walled sides, said heating unit substantially surrounding the firebox, wherein interior air flows for maximum transfer of heat from said firebox;

at least one register mounted at a remote location within the structure interior;

ventilation ducting connecting said at least one register to said at least one input of said heating unit for providing an air passageway from said at least one register to said heating unit;

at least one vent communicating with said at least one output from siad heating unit for outputting heated air from said heating unit to the interior of the structure;

a return air blower having an input and an output for forcibly moving return air from said at least one register to said at least one vent, said return air blower disposed within a path defined by said at least one register, said ventilation ducting, said heating unit and said at least one vent;

a smoke cone above said hollow pipes of said heating unit, said smoke cone having a closable outward opening in communication with the exterior of said structure for exhausting exhaust gas to the exterior, said smoke cone including an adjustable damper control for adjusting the size of said closable outward opening;

a water storing tempering tank having a top and a bottom, a water inlet and water outlet at said top and a water inlet and outlet at said bottom;

metal tubing encircling said firebox and attached to said firebox by heat exchanging plates, said metal tubing connecting said bottom water outlet to said top water inlet whereby colder water circulates out said bottom water outlet into said tubing where it is heated by contacting said firebox to produce heated water, said heated water flowing into the top water inlet, fresh cold water entering said tempering tank from a house supply through said bottom water inlet, hot water exiting to the structure plumbing through said top water outlet.

2. The heating system of claim 1 further comprising at least one pan for containing water at said at least one vent for humidifying the heated air output to the interior of the structure.

3. The heating system of claim 1 further comprising an ash pit below said firebox for receipt of burned combustible materials, said pit accessible from the exterior of said structure.

4. The heating system of claim 3 wherein said firebox bottom comprises a movable grate having a shaker handle and a plurality of horizontal members, said grate defining a platform for the combustible material within said firebox, wherein movement of said shaker handle moves said horizontal members whereby burned combustible materials drop between said horizontal members into said ash pit.

5. The heating system of claim 1 further comprising at least one pipe cleaner for cleaning said pipes, said at least one pipe cleaner defined by a substantially flat plate having a plurality of apertures having peripheries defining pipe passageways, said at least one pipe cleaner having a pipe cleaner handle grippable for sliding said at least one pipe cleaner over said pipes, said pipes being scraped by the periphery of the apertures thereby removing by-products of combustion from said pipes.

6. The heating system of claim 1 further comprising a combustion air blower for forcibly supplying fresh air to said firebox for combustion.

7. The heating system of claim 1 wherein said return air blower is adjustable between a maximum and minimum volumetric rate to forcibly move interior air at selectable volumetric rates.

8. The heating system of claim 7 further comprising a timer for timed operation of said adjustable return air blower whereby said adjustable return air blower is operable for timed increments at timed increments.

9. The heating system of claim 1 further comprising an auxiliary hot water heater, having a cold water input a hot water output and water heating means, said top water outlet of said tempering tank connected to said cold water input of said auxiliary water heater, said hot water output of said auxiliary water heater supplying heated water to the structure plumbing whereby when the fireplace furnace heating system is operating fully by continuous burning of combustibles therein, said auxiliary hot water heater is substantially inactive functioning only for storage of hot water, when the fireplace furnace heating system operates at a substantially reduced level, said auxiliary hot water heater water heating means operates to heat water supplied to the structure plumbing.

10. The heating system of claim 1 further comprising at least one air filter disposed along a path defined by said at least one register, said ventilation ducting said return air blower and said at least one vent for removing airborne materials from said return air.

11. The heating system of claim 6 wherein said combustion air blower is adjustable to forcibly supply air at selectable volumetric rates.

12. The invention of claim 1 wherein the combustible material is coal.

13. The invention of claim 1 wherein the combustible material is at least one of wood and paper.

14. The invention of claim 7 further comprising a thermally sensitive heat limit switch located proximately to said heating unit, said heat limit switch settable to a threshold level whereby upon sensing a temperature above said threshold level said switch activates said return air blower to its maximum volumetric rate until the temperature sensed falls below the threshold level.

15. The invention of claim 1 further comprising a draft relief, said draft relief operable to provide an openable vent from the firebox to allow escape of combustion air from the firebox to limit combustion of the combustible materials therein.

16. The invention of claim 1 further comprising a closable draft by-pass providing an air passageway from the structure exterior to substantially immediately adjacent and above a said firebox side for admitting exterior air immediately above said firebox to provide rapid combustion.

17. A fireplace furnace heating system for a structure having an interior and an exterior and a plumbing system, comprising:

means for combusting fuel, said means including a combustion area and means for providing air for combustion;

a chambered heating unit having at least one air input, first and second plural walled sides and a plural walled back, said plural walled back divided by barriers into essentially three chambers, said first and second plural walled sides divided by barriers into essentially two chambers, said plural walled, chambered back and sides defining cavities for movement of air therein, said top of said heating unit comprising plural hollow pipes connecting said first and second plural walled sides, said heating unit substantially surrounding said combustion area, wherein interior air flows into a center chamber of said plural walled back, leaves said center chamber in two directions, a portion of the air entering a first side chamber of said back, remaining air entering a second side chamber of said back, air from said first side back chamber entering an input chamber of said first plural walled side, the air being carried to an exhaust chamber of said second plural walled side by a subset of said plural hollow pipes, aid air being returned to the interior by an opening in said exhaust chamber of said second plural walled side, air from said second side chamber of said back entering an input chamber of said second plural walled side, the air being carried to an exhaust chamber of said first plural walled side by a remainder of said plural hollow pipes, the air being returned to the interior by an opening in said exhaust chamber of said first plural walled side, for maximum transfer of heat from said combustion area; and, means for forcibly circulating interior air through said heating unit and back to the interior.

18. The heating system of claim 17 further comprising water heating and storing means.

19. The heating system of claim 18 wherein said water storing and heating means comprises a tempering tank and piping carrying water from tempering tank to said combustion area and back to said tempering tank.

20. The heating system of claim 17 wherein said means for combusting fuel comprises a firebox having plural sides and a grate for placement of combustible material, said firebox defining said combustion area, and a closable conduit carrying fresh air from the exterior to the firebox for combusting the combustibles.

21. The heating system of claim 17 wherein said means for forcibly circulating interior air includes a remote register in said structure, said register defining an opening to ducting carrying inside air to said chambered heating unit.

22. The heating system of claim 20 further comprising a blower for forcibly moving combustion air through said closable conduit.

23. The heating system of claim 17 wherein said means for forcibly circulating interior air is programmable for activation for timed increments at timed increments.

24. The heating system of claim 17 wherein said means for forcibly circulating interior air is adjustable between a minimum and maximum to control a volume of air circulated.

25. The heating system of claim 24 further comprising a heat limit switch disposed in proximity to said chambered heating unit, said heat limit switch having a threshold temperature limit, said heat limit switch setting said means for forcibly circulating interior air to said maximum when the threshold temperature limit is exceeded.

26. The heating system of claim 19 further comprising an auxiliary water heater for receiving water from said tempering tank, said auxiliary water heater delivering water to the structure plumbing, said auxiliary water heater having a temperature threshold sensor, said auxiliary water heater heating water received from said tempering tank if below said temperature threshold.

27. The heating system of claim 17 further comprising a smoke cone disposed above said combustion area, said smoke cone funneling exhaust gasses from combustion to the exterior through an adjustable opening in said smoke cone.

* * * * *